United States Patent [19]

Glöyer

[11] 4,314,639

[45] Feb. 9, 1982

[54] FOLDING BOX CARRYING CONTAINER WITH ADHESIVE SEAL FOR CARRYING STANDING BOTTLES

[76] Inventor: Wolfgang Glöyer, Wiesenweg 51, D-2000 Oststeinbek, Fed. Rep. of Germany

[21] Appl. No.: 122,971

[22] Filed: Feb. 20, 1980

[30] Foreign Application Priority Data

Feb. 22, 1979 [DE] Fed. Rep. of Germany ... 7905025[U]
Oct. 24, 1979 [DE] Fed. Rep. of Germany ..... 2942908

[51] Int. Cl.[3] ..... B65D 5/46; B65D 25/30

[52] U.S. Cl. ..... 206/427; 206/141; 229/52 B

[58] Field of Search ..... 206/427, 141, 142, 143; 229/15, 28 BC, 52 B, 52 BC

[56] References Cited

U.S. PATENT DOCUMENTS

| | | | |
|---|---|---|---|
| 2,788,933 | 4/1957 | Kessler | 229/52 B |
| 2,986,324 | 5/1961 | Anderson | 229/52 B |
| 3,933,303 | 1/1976 | Kirley | 206/141 |
| 3,974,911 | 8/1976 | Graser | 206/141 |
| 3,994,432 | 11/1976 | Kirley | 206/427 |

FOREIGN PATENT DOCUMENTS

| | | | |
|---|---|---|---|
| 650568 | 10/1962 | Canada | 229/52 B |
| 877792 | 8/1971 | Canada | 229/52 B |
| 1912769 | 11/1979 | Fed. Rep. of Germany | 229/52 B |
| 2245530 | 5/1975 | France | 229/28 BC |

*Primary Examiner*—Herbert F. Ross
*Attorney, Agent, or Firm*—Beveridge, DeGrandi & Kline

[57] ABSTRACT

A folding box blank forming a carton which can be carried from the top with one hand. A one-part, rectangular punched blank forms, due to the nature of the fold in the top wall, a reliable carrying opening having a plurality of superimposed layers. As a result of the adhesive seal construction, it is possible to open and reclose the folding box carrying container without any damage taking place, so that it can be reused for carrying back empty bottles. The folding box carrying container can be stored in the horizontal position on shelves and is therefore particularly suitable for receiving six wine bottles, which can be removed from the folding box carrying container after opening the cover walls. After removing the bottles, the horizontal folding box carrying container can be folded up into the closed state for dust-proof storage, because the cover walls are held together by the flap in the upper cover wall. When used as a storage box on shelves, the folding box carrying container makes it unnecessary to unpack and repack wine bottles, for example in hotels and restaurants, because when stored in such a space-saving manner, it is possible to remove the individual bottles from the horizontal box. The outer, labelled cover flap wall can be provided with simple means, for example with the price list number, so that there is no need to directly label the bottles in the folding box carrying container.

8 Claims, 6 Drawing Figures

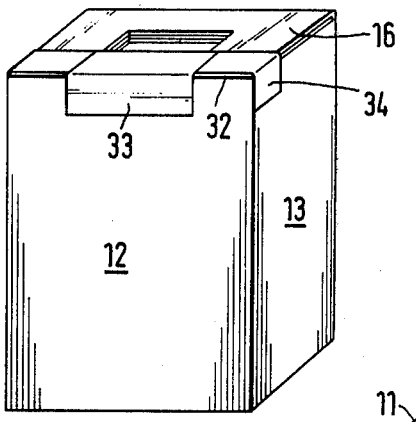
FIG. 1
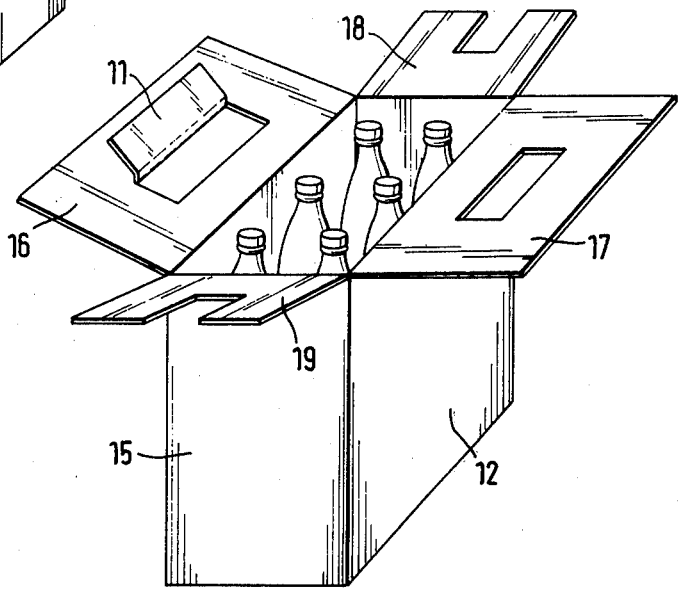
FIG. 4
FIG. 5
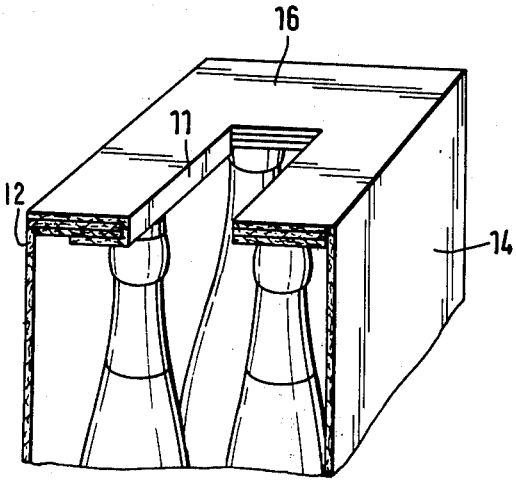
FIG. 6
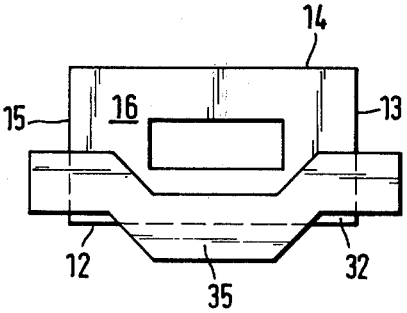

FOLDING BOX CARRYING CONTAINER WITH ADHESIVE SEAL FOR CARRYING STANDING BOTTLES

The present invention relates to a container for standing bottles in two rows which is constructed as a folding box having a carrying means and which is formed from a one-piece folding box blank with wall portions connected along fold lines.

The object of the invention is to provide a folding box carrying container for preferably six bottles having a carrying opening accessible from the top and comprising a plurality of layers of cardboard, whereby it must be inexpensive and uncomplicated. Importance is attached to accessibility from the front and the avoidance of any outward projection of the carrying means, so that the container containing the bottles can be easily arranged with similar containers on pallets and stacked. As a result, a, for example, standing or lying container can easily be removed with one hand from a shelf or a lattice box.

According to the invention, this object is achieved by a container having its top cover wall provided with punched openings and is formed from wall portions with a flap which serves to form a carrying opening the upper and central layers of said wall portions being formed from two longitudinal folding walls, which substantially coincide with one another in the final state of the folding box, and a lower layer formed by two transverse folding walls which supplement one another to form a single layer. The prepunched, twice slotted flap in the upper longitudinal folding wall is brought into such a spatial arrangement in the folding box blank that in the final state of the folding box it is folded around the congruent punched openings in the central and lower layers in such a way that it forms a carrying opening comprising the three layers of the cover wall portions and the foldedover flap. In a folding box carrying container filled with six bottles, this flap is held in position by the central bottle of a row so that the wall portions forming the cover cannot open of their own accord.

According to the invention, an advantageous further development is possible by providing the two transverse folding walls, which form the lower layer of the cover wall of the folding box with, in addition to the prepunched openings on their front edges, projections and recesses which engage one another in the final state of the folding box. This increases the strength and stability of the folding box in the vicinity of the cover wall.

An additional advantageous further development of the novel folding box carrying container is to seal the same with a frontal adhesive seal which in each case only covers part of the edges of the outer, upper cover wall, leaving suitable guide slots in the edges for inserting a razor blade for easy opening of the adhesive seal.

The invention is described in an exemplary manner hereinafter with reference to the drawings, where:

FIG. 1 is a perspective view of a folding box carrying container according to the invention viewed in an inclined upwards direction.

FIG. 4 is a perspective view of the folding box carrying container according to the invention with the longitudinal and transverse folding walls of the folding box which form the cover wall opened.

FIG. 5 is a perspective cross-section of the cover walls folded in, with the upper cover wall flap folded around the opening.

FIG. 6 depicts an approximately T-shaped, one-part adhesive tape for sealing and labelling the folding box carrying container in one operation.

Figure 2:
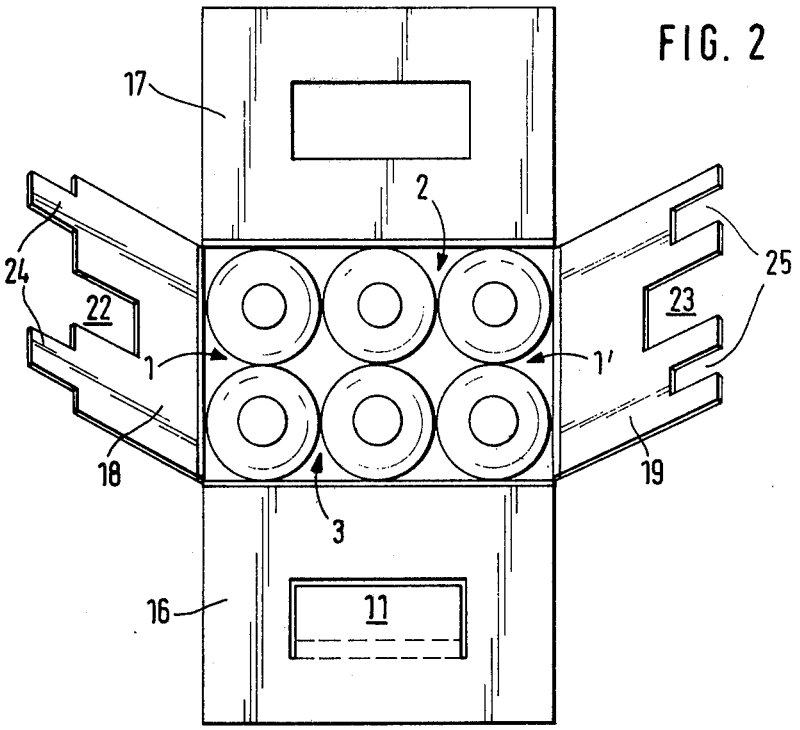
FIG. 2 is a plan view of the folding box carrying container of FIG. 1 with the longitudinal and transverse folding walls forming the cover wall opened, i.e. for example prior to the closing of the container with the standing bottles.

In FIG. 1, upper cover wall 16 of the finished folding box is provided its in centre with an inwardly folded flap 11 which serves to form a carrying opening. The folding box includes a longitudinal wall 12 and a transverse wall 13. An adhesive seal 33, 34 is provided comprising two superimposed adhesive tapes with a slit 32 for inserting the razor blade.

Figure 3:
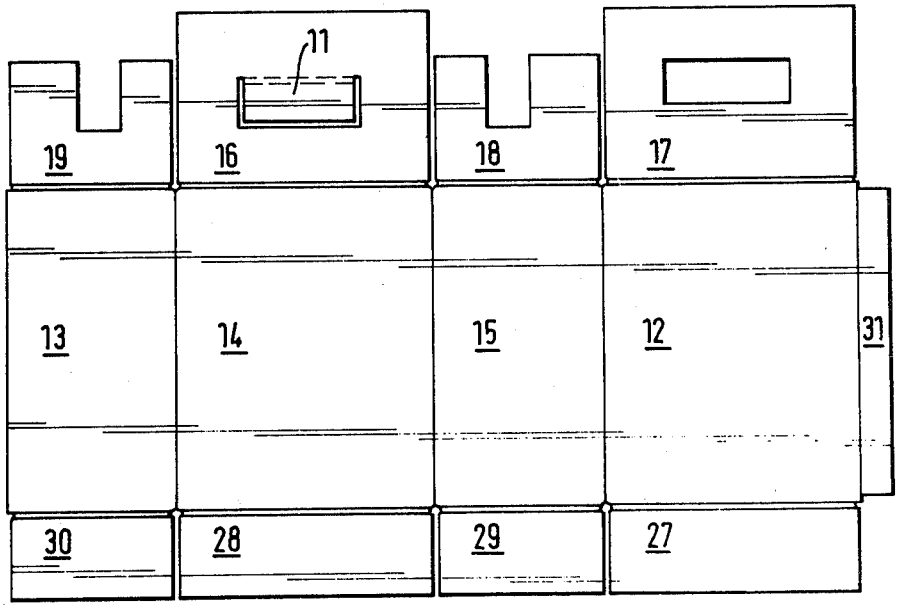
FIG. 3 is a developed view of the folding box blank.

The cover wall comprises longitudinal walls 16, 17 and transverse walls 18, 19. In accordance with the folding sequence 1 or 1', 2 and 3 indicated in FIG. 2, the walls are flapped over one another to close the folding box, and as a result the cover wall is formed. The longitudinal folding wall 16 contains, as shown in FIGS. 2 and 3, a prepunched, double-slotted flap 11 so positioned that in the final state of the folding box, flap 11 is folded around the superimposed, congruent punched openings in longitudinal and transverse folding walls 17, 18 and 19. The longitudinal folding walls 16, 17 are dimensioned in such a way that they substantially completely cover one another in the finished cover wall. The transverse folding walls 18, 19 are dimensioned in such a way that in the final state of the folding box they supplement one another to form a layer, without any reciprocal covering or overlapping. The front edges of transverse folding walls 18 and 19 can have projections 24 and/or slots 25 which engage with one another on folding in the transverse folding walls. The folding box blank shown in FIG. 3 also contains longitudinal and transverse folding walls 27, 28, 29 and 30 for forming the folding box bottom. In addition, a connecting tongue 31 is provided which, in the final state of the folding box, is fixed to the adjacent wall 13 by hot glue or clips. Corrugated board or ordinary smooth board can be used as the material for making the folding box carrying container.

FIG. 5 shows how the cover wall portions 16, 17, 18, 19 are secured by the central bottle in the front row after folding in flap 11.

FIG. 6 shows a one-part adhesive tape 35, in the form of a label, for sealing the folding box carrying container at the front. This approximately T-shaped tape joins the cover wall 16 to the side walls 15, 12, 13.

I claim:

1. A carton blank cut and scored to permit folding and assembly as a carton for beverage bottles standing therein in rows, said blank comprising a one-piece cardboard member having score lines to define a first end wall portion, a first sidewall portion extending from one side of said first end wall portion, a second end wall extending from one side of said first sidewall portion, a second sidewall portion extending from one side of said second end wall portion, first and second transverse top wall portions extending respectively from a first end of each of the first and second end wall portions, first and second longitudinal top wall portions extending respectively from a first end of each of the first and second sidewall portions, and a plurality of bottom wall portions extending respectively from a second end of separate ones of the end wall and sidewall portions; said score lines permitting folding of said carton blank to a position with said bottom wall portions defining a carton bottom, said first and second end wall portions extending in spaced parallel relation and said first and second sidewall portions extending in spaced parallel relation and cooperating with said first and second end wall portions to define a rectangular carton, and said first and second transverse top wall portions and first and second longitudinal top wall portions overlapping to provide a carton top of at least three layers; said first longitudinal top wall portion having a rectangular opening cut therethrough; said first and second transverse top wall portions being cut so that in the folded carton position with said first longitudinal top wall portion overlying said first and second transverse top wall portions a rectangular opening exists through said transverse top wall portions substantially congruent with the first longitudinal top wall portion rectangular opening; said second longitudinal top wall portion being cut and scored to define a foldable rectangular flap capable in the folded carton position, with said second longitudinal top wall portion overlying said first longitudinal top wall portion, of folding around one longitudinal edge of the congruent rectangular openings to place a major portion of said flap in a plane parallel with the plane of said first longitudinal top wall portion; said major portion, when said carton is assembled, filled and closed, being held in said plane by a bottle within said carton.

2. A carton blank as claimed in claim 1 in which the longitudinal edges of the rectangular opening in said first longitudinal top wall portion extend substantially parallel with the longitudinal edges of said first longitudinal top wall portion.

3. A carton blank as claimed in claim 1 in which each of said first and second transverse top wall portions includes cooperating projections and recesses adapted to engage when said carton blank is in the folded carton position to assist in retaining said carton blank in the folded carton position.

4. A carton blank as claimed in claim 1, 2, or 3 further comprising ahesive seal means for holding said transverse and longitudinal top wall portions in overlying position when said carton blank is in the folded carton position.

5. A carton blank as claimed in claim 4 in which said adhesive seal means covers only part of the edges of the top wall portion when said carton blank is in the folded carton position, leaving uncovered slits for opening of the seal.

6. A carton blank as claimed in claim 5 in which said adhesive seal means comprises a first adhesive tape affixed, when said carton blank is in the folded carton position, longitudinally across said second longitudinal top wall portion, over the end edges thereof, and onto said first and second end wall portions, and a second adhesive tape affixed on said second longitudinal top wall portion, over a side edge thereof, and onto said first sidewall portion.

7. A carton blank as claimed in claim 6 in which said second adhesive tape comprises a label.

8. A carton blank as claimed in claim 5 in which said adhesive seal means comprises a T-shaped member with the top of the T-shaped member extending, when said carton blank is in the folded carton position, longitudinally across said second longitudinal top wall portion, over the end edges thereof, and onto said first and second end wall portions, and with the base of the T-shaped member extending from the second longitudinal top wall portion, over a side edge thereof, and onto said first sidewall portion.

* * * * *